United States Patent [19]

Hamai et al.

[11] 4,419,601

[45] Dec. 6, 1983

[54] SPARK PLUG FOR INTERNAL COMBUSTION ENGINE

[75] Inventors: Kyugo Hamai, Yokosuka; Yasuhiko Nakagawa, Kamakura; Meroji Nakai, Yokosuka; Ryuzaburo Maruyama, Fujisawa, all of Japan

[73] Assignee: Nissan Motor Company, Limited, Yokahama, Japan

[21] Appl. No.: 202,157

[22] Filed: Oct. 30, 1980

[30] Foreign Application Priority Data

Nov. 5, 1979 [JP] Japan ..... 54-143073
Mar. 10, 1980 [JP] Japan ..... 55-30011

[51] Int. Cl.[3] ..... H01T 13/52; H01T 13/32

[52] U.S. Cl. ..... 313/131 A; 313/141; 313/143

[58] Field of Search ..... 313/131 A, 130, 131 R, 313/139, 141, 143

[56] References Cited

U.S. PATENT DOCUMENTS

| | | | |
|---|---|---|---|
| 3,967,149 | 6/1976 | Eaton et al. | 313/141 |
| 3,995,184 | 11/1976 | Insley | 313/131 A |
| 4,110,667 | 8/1978 | Graf vom Hagen | 313/143 |
| 4,261,085 | 4/1981 | Nishio et al. | 29/25.12 |
| 4,264,844 | 4/1981 | Axe et al. | 315/111 |

FOREIGN PATENT DOCUMENTS

| | | | |
|---|---|---|---|
| 709829 | 6/1954 | United Kingdom | 313/131 |
| 711778 | 7/1954 | United Kingdom . | |
| 744412 | 2/1956 | United Kingdom | 313/131 A |
| 765264 | 1/1957 | United Kingdom . | |
| 799838 | 8/1958 | United Kingdom . | |
| 809460 | 2/1959 | United Kingdom . | |
| 871857 | 7/1961 | United Kingdom . | |
| 901238 | 6/1962 | United Kingdom . | |
| 1005767 | 9/1965 | United Kingdom | 313/131 |
| 1131042 | 10/1968 | United Kingdom . | |
| 1310499 | 3/1973 | United Kingdom . | |
| 1410471 | 10/1975 | United Kingdom . | |
| 1470482 | 4/1977 | United Kingdom . | |
| 1510468 | 5/1978 | United Kingdom . | |
| 1521313 | 8/1978 | United Kingdom . | |
| 1522989 | 9/1978 | United Kingdom . | |
| 1544203 | 4/1979 | United Kingdom . | |
| 2032519A | 9/1979 | United Kingdom . | |

*Primary Examiner*—Eugene R. LaRoche
*Attorney, Agent, or Firm*—Lane, Aitken & Kananen

[57] ABSTRACT

A spark plug for an internal combustion engine disclosed herein includes a resistive semiconductor body connecting a center electrode and an earth electrode to perform a creeping discharge at low discharge voltages while keeping adequate ignition performances.

According to the invention, the spark plug comprises a back electrode at the back of a discharging gap to cause the creeping discharge on surfaces of an electric insulator which is resistant to electrolytic corrosion, thereby improving the durability of the plug and eliminating the trouble of electric waves of noises.

4 Claims, 13 Drawing Figures

SPARK PLUG FOR INTERNAL COMBUSTION ENGINE

BACKGROUND OF THE INVENTION

1. Field of the Invention

The present invention relates to a spark plug for an internal combustion engine, and more particularly to a spark plug adapted to jet plasma gases into a combustion chamber with the aid of self-induction electromagnetic force in the spark discharge to improve its ignitability.

2. Description of the Prior Art

In order to improve various performances of internal combustion engines, particularly gasoline engines, superior ignition performances must be ensured.

For example, with the extra lean mixture combustion system or exhaust gas recirculation system (EGR) which is considered to be effective to restrain the production of NOx to meet the strict exhaust gas regulation and limitation of poisonous material exhausts for automobile engines, how to reliably ignite the extra lean mixture or intake mixture including large amounts of exhaust gases is very important for ensuring required output performances.

For these purposes, various kinds of ignition systems have been proposed to improve the ignition performance. One of them is a spark plug utilizing electromagnetic force in spark discharge.

This spark plug comprises a main body 1 through which passes a center electrode 3 supported by an insulator 2 as shown in FIG. 1. The center electrode 3 has at its end a disc-like expansion 4 about which is formed a cylindrical earth electrode 6 with a discharging gap 5. There is provided a gas space 7 between the inside of the earth electrode 6 and the insulator 2.

With this spark plug 1, an electric current flows between the electrodes 6 and 4 by spark discharge to cause electromagnetic force which forces plasma gas (high temperature gas irons) produced in the gas space 7 in a spark discharging state into the combustion chamber to improve its ignitability or ignition performance.

Referring to FIG. 2, an electric current I flows from the earth electrode (positive electrode) 6 to the center electrode (negative electrode) 4 by the spark discharging to produce a magnetic field (whose magnetic flux density is Bo) in a clockwise direction about the current I flowing through the discharging gap 5. On the other hand, the current I flows through the center electrode 3 in its axial direction to cause a magnetic field (whose magnetic flux density is Bi) about the center electrode 3 in a clockwise direction.

The difference B(I) between the magnetic flux densities Bi and Bo of the inner and outer magnetic fields is indicated as $B(I)=Bi-Bo>0$. The inner magnetic flux density Bi overcomes the outer flux density Bo, so that an electromagnetic force F is caused from the gap space 7 to the exterior of the plug 1 or the combustion chamber.

The electromagnetic force F is indicated by the following equation.

$$F=\frac{\mu J(I)^2}{4\pi}\left(\ln\frac{r_a}{r_c}+\frac{1}{2}\right) \quad [A]$$

where $r_c$ is an outer radius of the center electrode 3 (expansion 4), $r_a$ is an inner radius of the earth electrode 6, J(I) is a current density and $\mu$ is a permeability.

This self-induction electromagnetic force F causes the high temperature plasma gas to rush into the center of the combustion chamber, thereby obtaining a very good ignition performance in comparison with the ignition in the proximity of a wall surface of a combustion chamber only by spark.

Moreover, it has been found that an electric potential in the order of several thousand volts is continuously supplied to such a spark plug at the same time of the spark discharge to perform the plasma ignition, thereby promoting the production and expansion of the plasma gas to obtain a better ignition performance.

In order to effectively produce the plasma gas with such a spark plug, however, a distance $r_a-r_c$ for the discharging gap 5 must be large to a certain extent which would tend to produce electric waves of noises.

Namely, the larger the discharging gap 5, the higher a dielectric breakdown voltage is, and particularly with the plasma ignition, plasma energy with a great amount of electric current is emanated in sparking, so that there is a tendency for the ignition discharge to generate violent electric waves of noises. The wave noises generally disturb the broadcasting of radio and television and may give rise to serious troubles in electronic instruments loaded or equipped on a vehicle. How to restrain the wave noises is, therefore, an important problem in this field.

A spark plug widely used in automobile engines or the like has generally an air gap as a spark gap, so that a dielectric breakdown under a high compressive pressure is so high that an ignition device for generating high voltages as high as more than 10 KV is required with a tendency to emanate the electric waves of noises. To avoid this, high voltage resistance wires have been used for ignition cords. However, such wires unavoidably cause ignition energy losses to a certain extent.

SUMMARY OF THE INVENTION

It is a general object of the invention to provide an improved spark plug for an internal combustion engine which eliminates the above disadvantages of the prior art by providing a resistive semiconductor body between positive and negative electrodes to perform a creeping discharge so as to lower the discharge voltages while keeping an adequate ignition performance.

It is a still more specific object of the invention to provide a spark plug for an internal combustion engine which comprises a back electrode at the back of a discharging gap to cause a creeping discharge on surfaces of an electric insulator which is resistant to electrolytic corrosion, therreby improving the durability of the plug and eliminating the trouble of electric waves of noises.

In order that the invention may be more clearly understood, preferred embodiments will be described, by way of example, with reference to the accompanying drawings.

DETAILED DESCRIPTION OF THE PREFERRED EMBODIMENT

A spark plug according to the invention comprises a ceramic resistive semiconductor connecting positive and negative electrodes to produce ignition discharge even at low voltages such as several KV.

Figure 1:
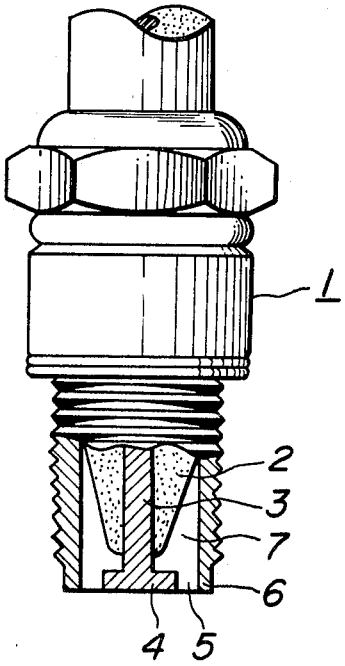
FIG. 1 PRIOR ART
FIG. 1 is an elevation, partially broken away, of a spark plug utilizing self-induction electromagnetic force of the prior art as mentioned above.
Figure 2:
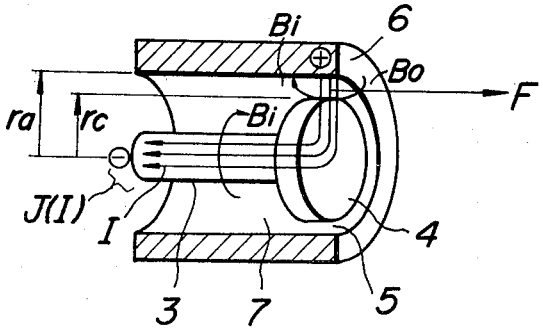
FIG. 2 PRIOR ART
FIG. 2 is an explanatory view of the spark plug in FIG. 1.
Figure 3:
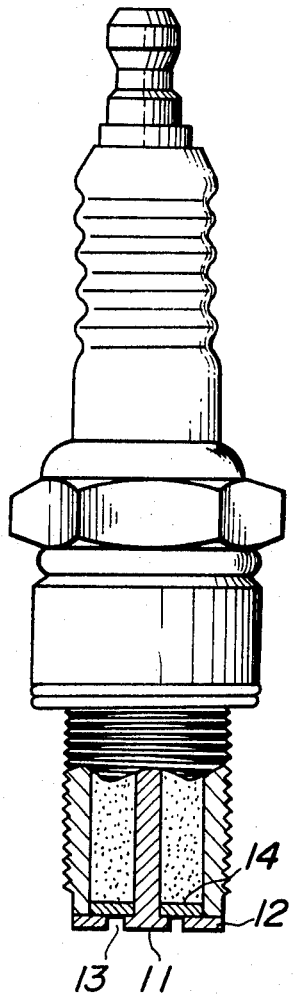
FIG. 3 is an elevation, partially broken away of a spark plug of a first embodiment of the invention.

Referring to FIG. 3, the spark plug according to the invention includes a creeping path by providing an electrode gap 13, between a center electrode 11 and an earth electrode 12, with a ceramic semiconductor 14 of silicon carbide. When an electric voltage is applied between the electrodes 11 and 12, a weak current flows through the ceramic semiconductor 14 to cause free electrons on a surface of the semiconductor 14 facing to the gap 13 so as to induce a creeping discharge, thereby enabling the ignition discharge to occur at low voltages, such as only 1–2 KV.

Figure 4:
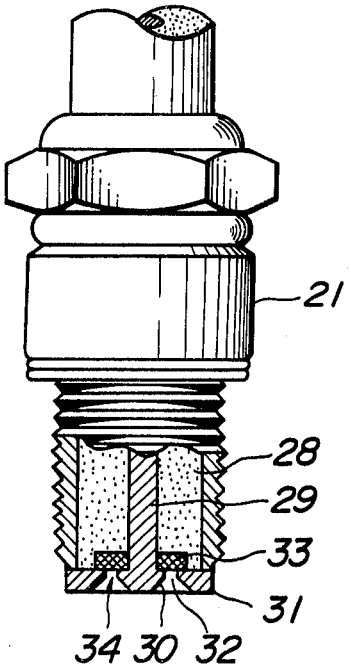
FIG. 4 is an elevation, partially broken away of a spark plug of a further embodiment of the invention.
Figure 5:
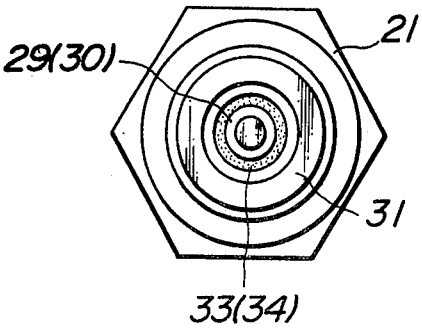
FIG. 5 is a bottom plan view of the spark plug shown in FIG. 4.

Referring to FIGS. 4 and 5 illustrating a further embodiment of the invention, a spark plug main body 21 includes an insulator 28 and a center electrode 29.

The center electrode (negative electrode) 29 is formed at its end with a tapered or conical expansion. On the other hand, an earth electrode (positive electrode) 31 has a conical surface diverging toward a combustion chamber so as to form an annular discharging gap 32 increasing the gap toward the combustion chamber. A resistive semi-conductor 33, for example, of $SiO_2$ is embraced in the insulator 28 between the positive and negative electrodes 29 and 31 to form an annular creeping discharge path 34 between the positive and negative electrodes 29 and 31. Instead of the independent resistant semiconductor 33, an end face of the insulator 28 may be covered by a resistant semiconductor film to form the discharge path 14.

With this arrangement, when a discharge voltage is applied between the positive and negative electrodes 29 and 31, a potential difference causes free electrons on a surface of the resistive semiconductor 33 or discharge path 34, through which an electric current flows from the earth electrode 31 to the center electrode 39 (expansion 30) by a creeping discharge. A dielectric breakdown voltage for the discharging is, therefore, very low, such as in the order of several thousand volts.

Figure 6:
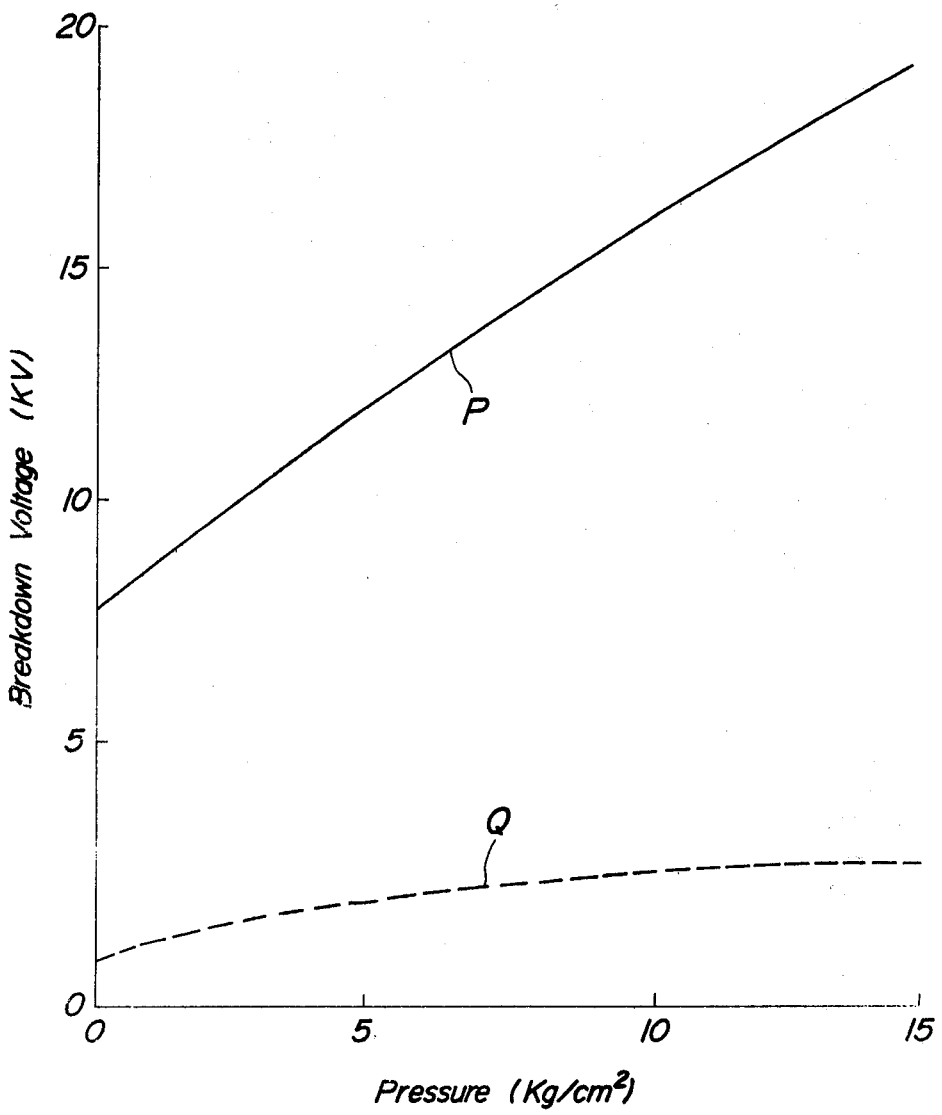
FIG. 6 is a graph illustrating the difference in dielectric breakdown voltage between spark plugs of the present invention and the prior art.

FIG. 6 illustrates relations between compressive pressures (kg/cm$^2$) and breakdown voltage (KV), where P shows the breakdown voltages in case of air gaps and Q shows the voltages in case of the creeping discharge. As can be seen in FIG. 6, the creeping discharge can be performed at very low voltages and the voltages for the creeping discharge do not increase even if the pressure in the cylinder is considerably increased. As the result, a discharging gap 12 can be widened to perfom the effective plasma ignition and the waves of noises can be reduced.

As in this embodiment, the expanded or conical discharging gap 32 serves to enhance the propulsion and jet of plasma gases. In this case, the electromagnetic force F is indicated by the following equation.

$$F = \frac{\mu J(I)^2}{4\pi}\left(\ln\frac{r_a}{r_c} + \frac{3}{4}\right)$$

In comparison of this equation with the above equation [A], the constant of the second term in the parenthesis is larger than that of [A], which means a stronger jetting force resulting in a better ignition performance.

Figure 7:
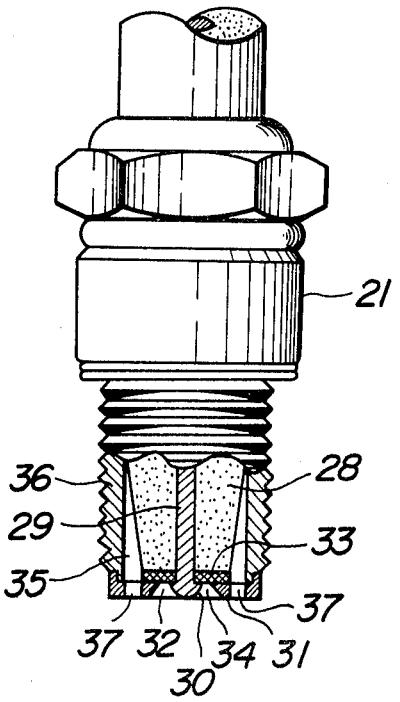
FIG. 7 is an elevation, partially broken away, of a spark plug of another embodiment of the invention.
Figure 8:
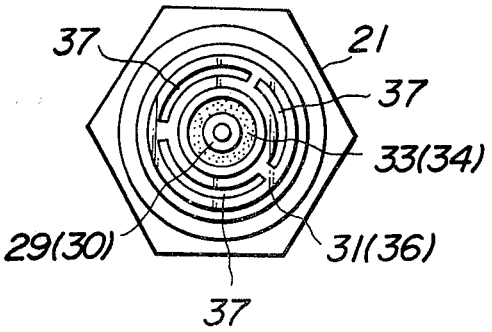
FIG. 8 is a bottom plan view of the spark plug shown in FIG. 7.

With an embodiment shown in FIGS. 7 and 8, a gas space 35 is formed about an insulator 28 to adjust a heating level. The gas space 35 is formed between the insulator 28 and an inside of a cylindrical portion 36 (earth electrode 31) having screw threads of the plug 21 to communicate with the exterior (combustion chamber) through arcuate communicating apertures 37 formed in the earth electrode 31. Other parts are similar to those in FIGS. 4 and 5, which are designated by the like numerals.

With this arrangement, the heating level can be set to meet conditions of use with the aid of change in heat dissipation characteristics depending upon the volume of the gas space 35, thereby obtaining an ignition plug having a stable ignition performance.

Figure 9:
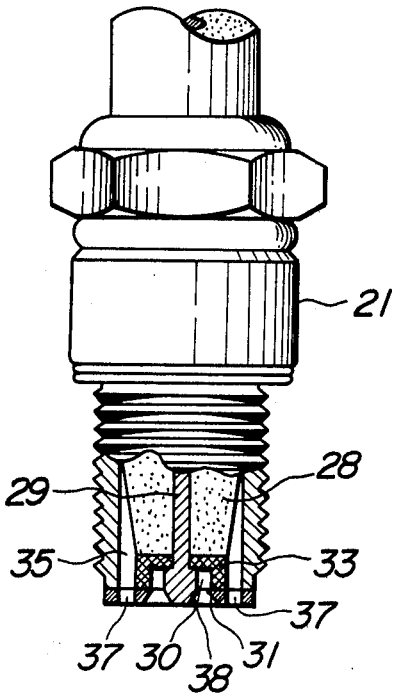
FIG. 9 is an elevation, partially broken away, of a spark plug of further embodiment of the invention.
Figure 10:
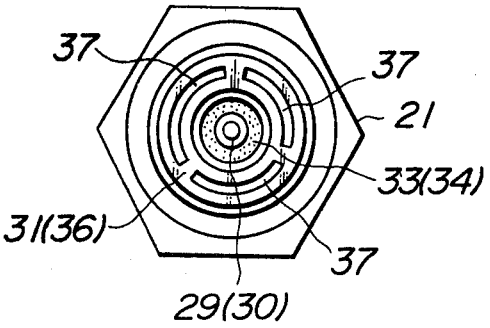
FIG. 10 is a bottom plan view of the spark plug shown in FIG. 9.

With an embodiment shown in FIGS. 9 and 10, a resistive semiconductor 33 is formed with a cavity 38 having a small volume opening toward a combustion chamber to increase volumes of produced plasma gases. The cavity 38 is annular and arranged between a center electrode 29 (expansion 30) and an earth electrode 31. Other parts are similar to those in FIGS. 7 and 8.

With this arrangement, the discharge current flows along the inner surfaces of the cavity 38. At the moment, as the cavity includes the mixture therein, a relatively large amount of the plasma gas is produced. Therefore, according to this embodiment, a great amount of the plasma gas jets into a combustion chamber to form favorable ignition flame cores which greatly serve to improve the ignitability of the plug.

Figure 11:
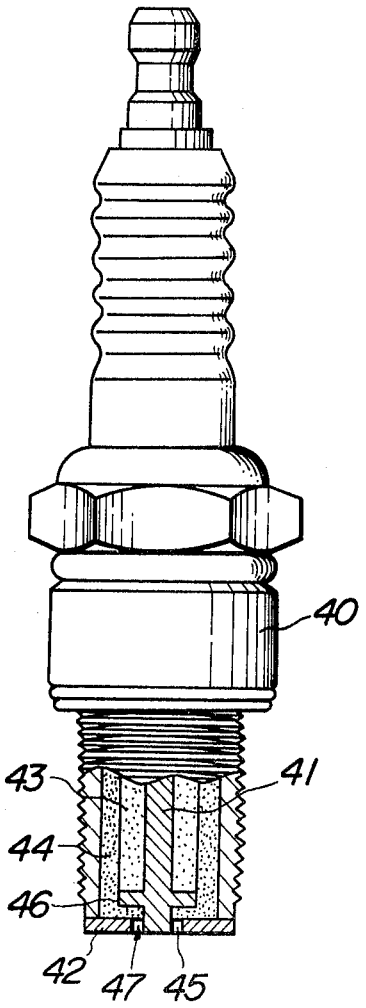
FIG. 11 is an elevation, partially broken away, of a spark plug provided with a back electrode according to the invention.

The ceramic resistive semiconductor is not necessarily sufficient to resist the continuous sparking. Under a certain condition, it is often damaged by electrolytic corrosion to an extent such that its performance cannot be maintained after the ignition discharge of 50–100 mJ has been repeated several ten thousands of times. FIG. 11 illustrates a preferable embodiment to avoid this. A plug 40 shown in FIG. 11 comprises a spark plug main body 40 including a center electrode 41 and an earth electrode 42. The center electrode 41 is arranged extending through two insulators (ceramics) 43 and 44 concentrically supported in the main body 40 to form an annular discharging space 45 with the earth electrode 42 surrounding the center electrode 41.

The center electrode 41 is integrally formed with a flange-like back electrode 46 radially extending at the back of the earth electrode 42 with a slight clearance. The back electrode 46 is so sized as to cover in a plane at least the discharging gap 45 in order to induce the creeping discharge on the ceramic surface facing the discharging gap 45 as later explained.

The first insulator 43 supporting the center electrode 41 is cylindrical and located over and at the back of the back electrode 46. The second insulator 44 surrounds the first insulator 43 in close contact therewith and fills up the clearance between the back and earth electrodes 46 and 42 to connect the center and earth electrodes 41 and 42 so as to form a creeping discharge path 47 facing to the discharging gap 45.

The operation of the plug as above constructed is as follows. If a potential difference between the center and earth electrodes 41 and 42 arises, free electrons emanate from the part of the insulator 44 embraced between the back electrode 46 and earth electrode 42 to the creeping discharge path 47. As a result of this, the dielectric breakdown voltage lowers abruptly, so that an electric discharge occurs at a low voltage such as 1–2 KV through the free electrons at the surface of the creeping discharge path 47. This discharge occurs along the creeping discharge path 47 having a lower electric resistance than that of the discharging gap 45. As the creeping discharge path 47 is formed on the surface of the insulating ceramic material 44 which is electrolytic corrosion-resistant, it exhibits a superior durability against the repeated discharge.

Figure 12:
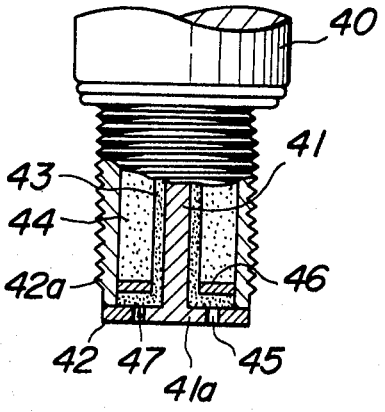
FIG. 12 is an elevation, partially broken away, of a spark plug of a modified embodiment of the plug shown in FIG. 11.

FIG. 12 illustrates another embodiment, wherein an earth electrode 42 is integrally formed with a back electrode 46. In the drawing, the back electrode 46 is formed inwardly extending from an inner surface of a cylindrical portion 42*a* of the earth electrode 42. A center electrode 41 has a flange-like and 41*a* to embrace a skirt of an insulator 43 between the flange-like end and the back electrode 46. In other words, with this embodiment, different from that of FIG. 11, the back electrode 46 extends inwardly and in connection therewith, and the skirt of the inner insulator 43 extends outwardly to form a creeping discharge path 47. As the operation of the plug will not be described because it is similar to that of the plug shown in FIG. 11. In the embodiments of FIGS. 11 and 12, when an electric current flows from the earth electrode 42 to the center electrode 41, owing to the action of the self-induction electromagnetic force caused by a current in a radial direction along the creeping discharge path 47 and a current in the center electrode 41 in its axial direction, high temperature gas ions produced by ionization in discharging are forced forwardly of the creeping discharge path 47 to form a fierce ignition flame core in a combustion chamber, which is effective in ignition and combustion.

Figure 13:
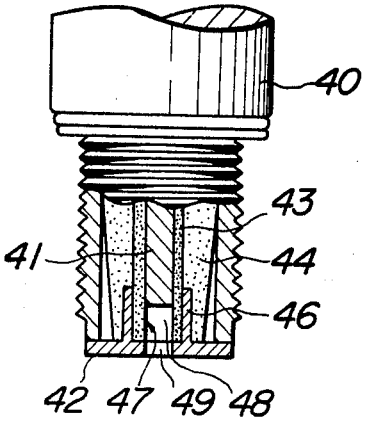
FIG. 13 is an elevation, partially broken away, of a spark plug including a discharging cavity according to the invention.

In contrast herewith, in an embodiment shown in FIG. 13, a discharging cavity 48 having a small volume is formed between a center electrode 41 and an earth electrode 42 and surrounded by an insulator 43, so that the gas ions (plasma gas) are produced in the discharging cavity 48 characterized by electric discharging with large energy and jets while expanding into a combustion chamber.

The center electrode 41 is arranged so as for its end to be located on an inner side of a cylindrical insulator 43 to form a small discharging cavity 48 between the center electrode 41 and the earth electrode 42 having a jetting aperture 49 formed concentrically with an inner bore of the insulator 43. In this case, the earth electrode 42 is integrally formed with the back electrode 46 to surround the creeping discharge path 47 of the discharging cavity 48 through the insulator 43 which is in turn surrounded by a second insulator 44.

According to this embodiment, as above described the discharging ignition can be carried out at low voltages and a great amount of plasma gas is produced in the discharging cavity by supplying a large amount of electric current and jets while expanding into the combustion chamber, thereby obtaining good ignition performance.

As can be seen from the above description, the spark plug adapted to jet the plasma gas by the self-induction electromagnetic force in electric discharging according to the invention comprises the resistive semiconductor between the positive and negative electrodes to cause the ignition current discharging by the creeping discharge at relatively low voltages, thereby enabling the discharging gap or discharge path to be enlarged to obtain effective plasma ignitions and restrain the electric waves of noises.

Furthermore, according to the invention, the back electrode is provided in a manner of covering the back of the creeping discharge path of a ceramic material as an insulator to produce the creeping discharge on the ceramic surface which is resistant to the electrolytic corrosion, thereby obtaining the low voltage spark plug for use in automobiles, which is durable and has no trouble with electric waves of noises.

Moreover, the spark plug according to the invention can be used for ignition means for Diesel engines because its dielectric breakdown voltage under high compressive pressure is considerably lower than that of the hitherto used air gap type spark plug.

It is further understood by those skilled in the art that the foregoing description relates to preferred embodiments of the disclosed spark plugs and that various changes and modifications may be made in the invention without departing from the spirit and scope thereof.

What is claimed is:

1. A spark plug for an internal combustion engine including positive and negative electrodes between which spark discharge occurs to produce self-induction electromagnetic force by means of which plasma gas is jetted into a combustion chamber of said internal combustion engine, comprising a resistive semiconductor body connecting said positive and negative electrodes to provide a creeping discharge, one of said electrodes being located at a center of the plug, and an insulator surrounding said one electrode, the other of said electrodes having a plurality of arcuate communicating apertures arranged in a circle and a cylindrical portion surrounding and spaced from said insulator to define a gas space about the insulator communicating with said combustion chamber through the apertures whereby the heat dissipation characteristics of said spark plug are a function of the volume of said gas space.

2. A spark plug for an internal combustion engine, comprising:

a spark plug main body which includes an insulator and a center electrode formed at its end with an expanded portion;

another electrode with a conical surface diverging toward a combustion chamber of said internal combustion engine to form an annular discharging gap which increases in width toward said combustion chamber, a spark discharge occurring between said center electrode and said another electrode to produce an electro magnetic force by means of which plasma gas is jetted into said combustion chamber from said discharging gap;

a resistive semiconductor body in the insulator between said center electrode and said another electrode to form an annular creeping discharge path therebetween;

said another electrode, defining with said insulator a gas space formed about said insulator, having a plurality of arcuate communicating apertures arranged in a circle about said insulator, said gas space communicating with the combustion chamber through said apertures, whereby the heat dissipation characteristics of said spark plug are a function of the volume of said gas space, which volume adjusts a heating level for said plug.

3. The spark plug as set forth in claim 2, wherein said another electrode includes a cylindrical portion surrounding and spaced from said insulator to define said gas space.

4. The spark plug as set forth in claim 3, wherein said center electrode is a negative electrode and said another electrode is an earth electrode.

* * * * *